US005419652A

United States Patent [19]

Flanders

[11] Patent Number: 5,419,652

[45] Date of Patent: May 30, 1995

[54] SNOW PLOW COMPATIBLE SPEED BUMPS

[75] Inventor: Stephen N. Flanders, Norwich, Vt.

[73] Assignee: U.S. Army Corps of Engineers as represented by the Secretary of the Army, Washington, D.C.

[21] Appl. No.: 213,896

[22] Filed: Mar. 16, 1994

[51] Int. Cl.[6] ..... E01F 13/00

[52] U.S. Cl. ..... 404/15; 14/69.5

[58] Field of Search ..... 404/15, 16; 14/69.5

[56] References Cited

U.S. PATENT DOCUMENTS

| | | | |
|---|---|---|---|
| 3,975,108 | 8/1976 | Suhr et al. | 404/16 |
| 4,687,370 | 8/1987 | Knowles | 404/15 |
| 4,697,294 | 10/1987 | Schafer | 404/16 X |
| 5,106,226 | 4/1992 | Fanslow et al. | 404/15 |
| 5,295,759 | 3/1994 | Flanders et al. | 404/15 |

FOREIGN PATENT DOCUMENTS

| | | | |
|---|---|---|---|
| 2596081 | 9/1987 | France . | |
| 2030197 | 4/1980 | United Kingdom | 404/15 |
| 2079356 | 1/1982 | United Kingdom | 404/15 |
| 2104946 | 3/1983 | United Kingdom | 404/16 |

*Primary Examiner*—Ramon S. Britts
*Assistant Examiner*—Pamela A. O'Connor
*Attorney, Agent, or Firm*—Luther A. Marsh

[57] ABSTRACT

A speed bump for use in connection with a roadway located in a climate where a snow plow is used to clear a roadway, the bump is made from roadway construction materials extending across each lane of a roadway, the bump having a crown of fixed width running substantially the length of the bump; the right-side of the bump having a conventional profile portion, the left-side having a tapered ramp portion having an incline equalling about ten to thirty degrees, allowing a snow plow to lift smoothly over the bump, a plurality of bumps having the same shape can be aligned to manage multiple-lane, one-way and two-way traffic.

4 Claims, 4 Drawing Sheets

SNOW PLOW COMPATIBLE SPEED BUMPS

STATEMENT OF GOVERNMENT INTEREST

The invention described and claimed herein may be manufactured and used by or for the Government of the United States of America for governmental purposes without the payment of royalties thereon or therefor.

This case is related to the patent application of STEPHEN N. FLANDERS ET AL. having Ser. No. 08/045,350, filed on Apr. 13, 1993, now Pat. No. 5,295,759.

FIELD OF INVENTION

The present invention pertains to speed bumps of the type used to control the speed of vehicular traffic on roads and, more particularly, to such speed bumps which are compatible with the use of snow plows.

DESCRIPTION OF PRIOR ART

Speed bumps are an effective means of preventing excessive speeds on roadways. The conventional speed bump consists of a ridge extending transversely to the direction of travel across one or across a plurality of traffic lanes. Such speed bumps are normally formed of paving material, like asphalt or concrete, and have a cross-sectional configuration approximating that of a segment of a circle with a sharp angle of intersection with the pavement surface. This sharp angle presents an obstacle for snow plows requiring careful operation on the part of the plow operator to avoid damage to the speed bumps and to the snow plow equipment. One approach to this problem has been the use of removable speed bumps. This, however, requires manual removal and installation, according to the season, and the desired traffic control is, obviously, lacking during the winter season.

A second approach is the use of speed dips rather than speed bumps. Speed dips involve cutting into the existing pavement surface which may contribute to the deterioration thereof.

SUMMARY OF THE INVENTION

It is the primary object of the present invention to provide speed bumps which are compatible with the use of snow plows on a road surface while maintaining the traffic control aspects of the bump.

It is also an object of the present invention to provide such speed bumps as permanent road features.

A further object of the present invention is the provision of permanent, snow plow compatible speed bumps which are formed of conventional road construction materials.

The above and other objects of the present invention are achieved by using speed bumps which have tapered ramp portions which provide a smooth transition from the pavement surface to lift a plow without jarring the plow or permitting unacceptable wear or damage to the speed bump. The ramp or ramps may be located so as to be engaged by the plow blade but laterally offset from the path of vehicle wheels thus maintaining the effectiveness of the speed bumps.

For a more complete understanding of the invention and the objects and advantages thereof, reference should be made to the accompanying drawings and the following detailed description wherein the preferred embodiments of the invention are illustrated and described.

DESCRIPTION OF THE PREFERRED EMBODIMENT

Suitable materials of which the speed bumps are made include, but are not limited to, asphalt, asphalt concrete, portland cement concrete, high-density elastomeric plastic such as neoprene or polyurethane, or metal such as aluminum or corrosion-resistant steel.

Figure 1:
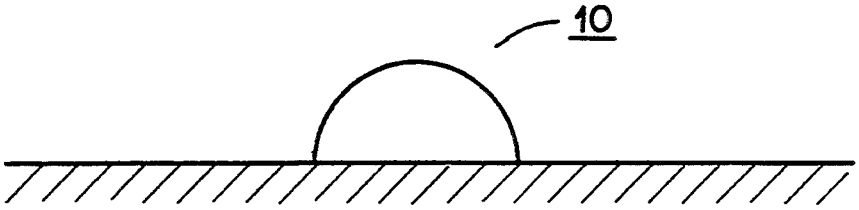
FIG. 1 is cross section of a conventional speed bump.
Figure 2:
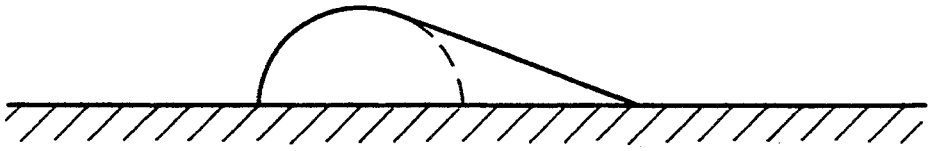
FIG. 2 is a cross section of the speed bump in the present invention illustrating the angle of taper employed.

A conventional speed bump 10 which is not snow plow compatible is depicted in FIG. 1. Speed bump 10 has a conventional profile that has a cross-sectional configuration approximating that of a segment of a circle with a sharp angle of intersection with the pavement surface. This sharp angle provides the desired speed control but presents an obstacle for snow plow equipment requiring careful operation of the plow operator to avoid damage to the speed bumps and the snow plow assembly. The present invention utilizes speed bumps that are snow plow compatible and is illustrated in FIGS. 2–7. Each one of the speed bumps illustrated have portions that are shaped in the conventional speed bump profiles. These portions are called conventional profile portions.

Figure 3:
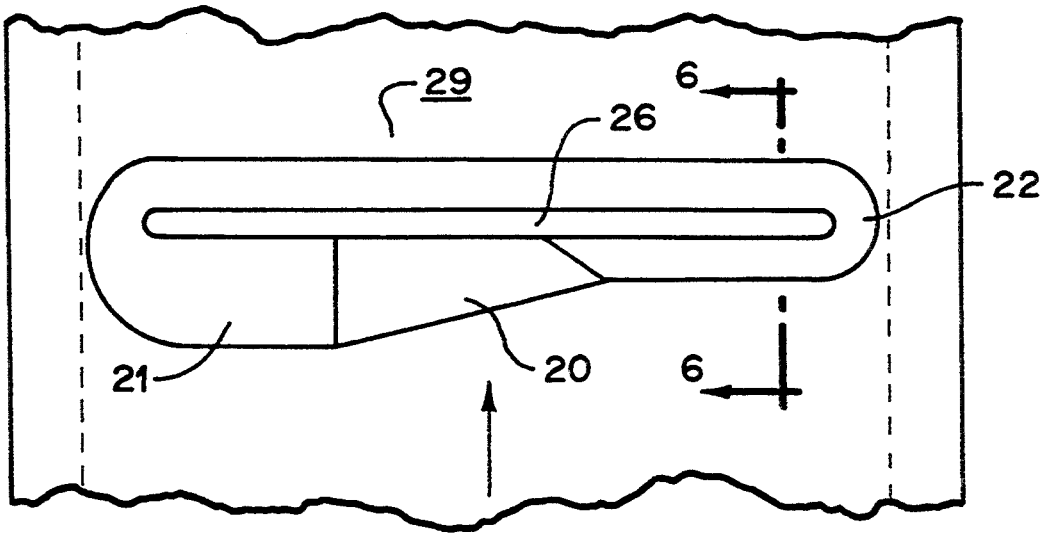
FIG. 3 is a plan view of a snow plow compatible speed bump of the present invention configured to manage single-lane, one-way traffic.
Figure 4:
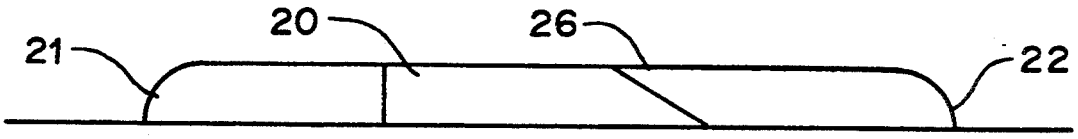
FIG. 4 is a side elevational view of the speed bump of FIG. 3.
Figure 5:
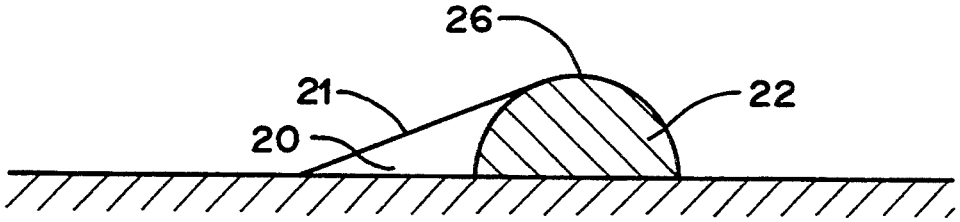
FIG. 5 is a transverse cross sectional view taken on line 5—5 of FIG. 3.
Figure 6:
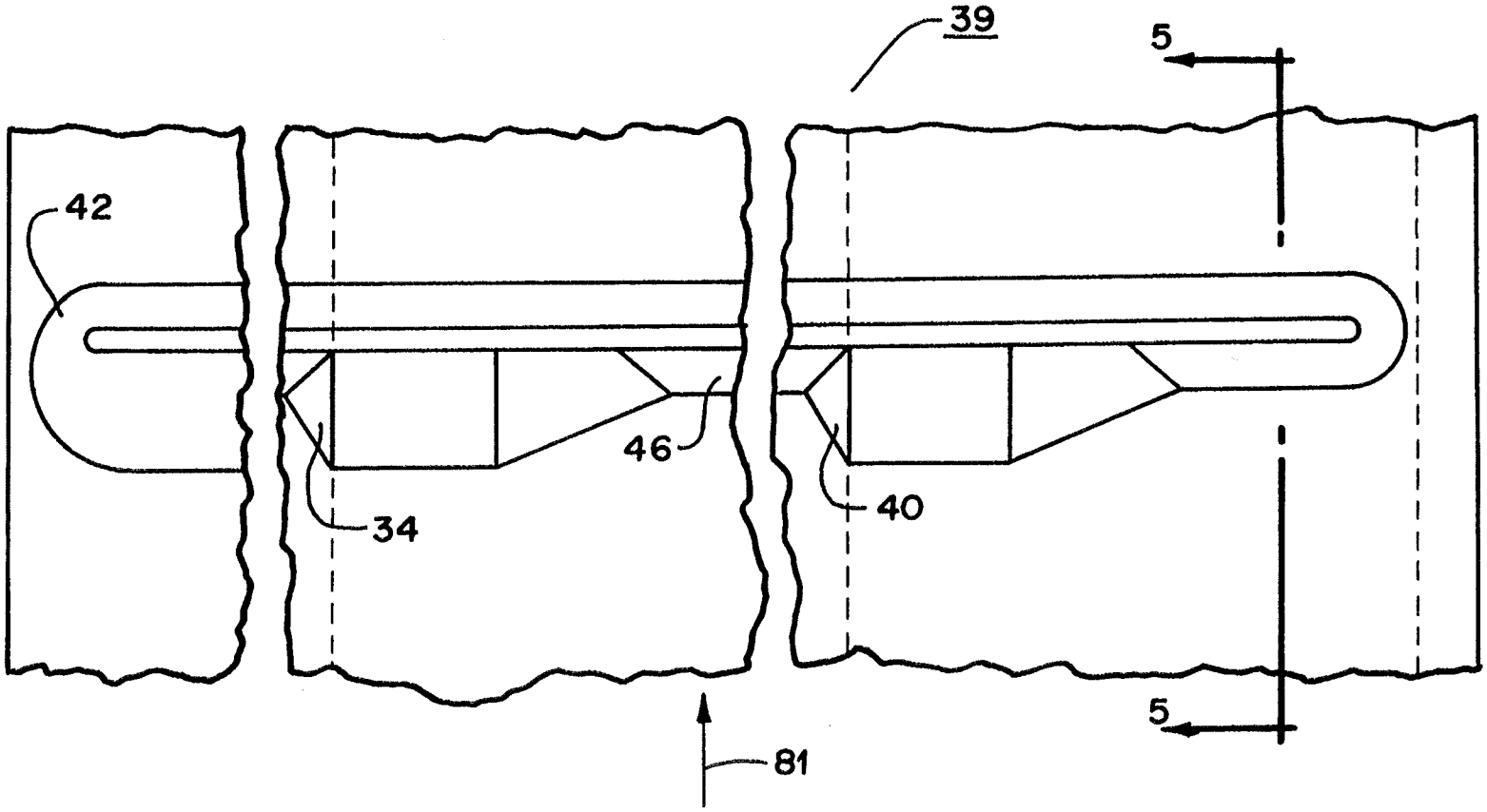
FIG. 6 is a plan view of a snow plow compatible speed bump of the present invention configured to manage multi-lane, one-way traffic.
Figure 7:
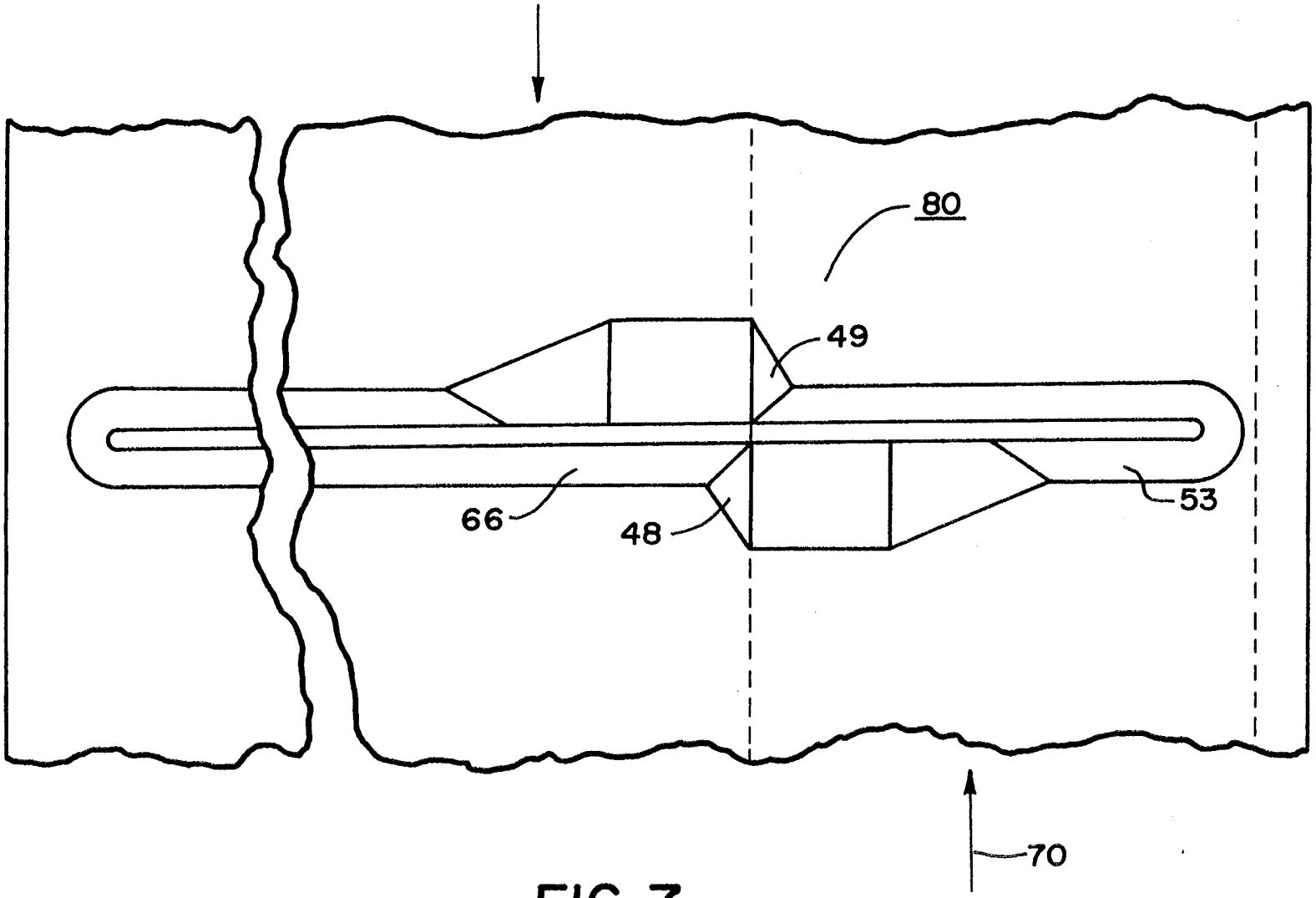
FIG. 7 is a plan view of a snow plow compatible speed bump of the present invention configured to manage multi-lane, two-way traffic.

FIG. 3 depicts a snow plow compatible speed bump 29 which can be configured to manage several different traffic patterns: single-lane, one-way traffic (FIG. 3); multi-lane, one-way traffic (FIG. 6); and multi-lane, two-way traffic (FIG. 7). Speed bump 29 of FIG. 3 includes an end portion 22 which is of a conventional speed bump configuration, a crown 26 which runs substantially the length of the bump 29, tapered ramp portions 21 and 20.

Tapered ramp portions 20 and 21 are configured to allow a snow plow to lift over bump 29, without jarring the plow or permitting unacceptable wear or damage to the bump 29. The incline of tapered ramp portion 21 is continuous and can range from about 10 to 30 degrees. The incline for tapered ramp portion 20 is no shallower than 10 degrees but smoothly transitions the incline to meet the conventional speed bump end portion 22.

The embodiment in FIG. 6 manages multi-lane, one-way traffic. FIG. 6 depicts a plurality of speed bumps 39 individually having a shape similar to the bump 29 of FIG. 3. These bumps are connected together across traffic lanes of a roadway, managing multi-lane, one-way traffic 81. The speed bumps 39 have tapered ramp portions that are similarly configured to the tapered ramp portions of the bump 29. The difference is that the bumps 39 have tapered portions 40 and 34 as illustrated in FIG. 6. Tapered ramp portions 40 and 34 have an angle or incline no shallower than 10 degrees but smoothly transitions the incline to meet that of the conventional speed bump end portions 42 and 38.

FIG. 7 depicts a plurality of speed bumps 80 individually having a shape similar to the bump 29 in FIG. 3. The bumps 80 are connected together across traffic lanes of a roadway to manage multi-lane, two-way traffic 70 and 90. The speed bumps 80 have tapered ramp portions of bumps 80 are similarly configured to the tapered ramp portions in bumps 29. The difference is that the bumps 80 have tapered ramp portions 48 and 49 as illustrated in FIG. 7. These tapered ramp portions 48 and 49 have an angle or incline no shallower than 10 degrees but smoothly transition to meet that of the conventional speed bump end portions 53 and 66.

It will be appreciated that while the preferred embodiment of the invention has been illustrated and described in detail herein, changes and additions may be had therein and thereto without departing from the spirit of the invention. Reference should, accordingly, be had to the appended claims in determining the true scope of the invention.

What is claimed is:

1. A speed bump for use in connection with a roadway located in a climate where a snow plow is used to clear the roadway comprising:

a speed bump fabricated from roadway construction material;

said bump extending across each lane of a roadway;

said bump having a crown of fixed width running substantially the length of said bump;

said bump having two tapered ramp portions located on the left-hand side of each lane of said roadway, as seen from the direction of travel;

said first tapered ramp portion having an incline between about ten to thirty degrees, allowing a snow plow to lift smoothly over said bump;

said second tapered ramp portion having an incline no shallower than 10 degrees;

said bump having a conventional profile portion on the right-hand side of each lane of said roadway, as seen from the direction of travel.

2. The speed bump of claim 1 wherein a plurality of said bumps are attached together across a plurality of traffic lanes, each facing the same direction of travel, managing multiple-lane, one-way traffic.

3. The speed bump of claim 1 wherein a plurality of said bumps are attached together across a plurality of traffic lanes, each facing opposite directions of travel, managing multiple-lane two-way traffic.

4. The speed bump of claim 1 wherein said roadway construction material is selected from the group consisting of asphalt, asphalt concrete, portland cement concrete, high-density elastomeric plastic, and corrosion-resistant metal.

* * * * *